US012044404B2

(12) United States Patent
Stanton

(10) Patent No.: US 12,044,404 B2
(45) Date of Patent: Jul. 23, 2024

(54) GAS NOZZLE CLEANING METHOD AND SYSTEM

(71) Applicant: Edwards Limited, Burgess Hill (GB)

(72) Inventor: Gareth David Stanton, Clevedon (GB)

(73) Assignee: Edwards Limited, Burgess Hill (GB)

( * ) Notice: Subject to any disclaimer, the term of this patent is extended or adjusted under 35 U.S.C. 154(b) by 252 days.

(21) Appl. No.: 17/767,678

(22) PCT Filed: Oct. 7, 2020

(86) PCT No.: PCT/GB2020/052471
§ 371 (c)(1),
(2) Date: Apr. 8, 2022

(87) PCT Pub. No.: WO2021/069884
PCT Pub. Date: Apr. 15, 2021

(65) Prior Publication Data

US 2022/0397268 A1 Dec. 15, 2022

(30) Foreign Application Priority Data

Oct. 9, 2019 (GB) ..... 1914595

(51) Int. Cl.
*F23D 14/50* (2006.01)
*F23G 7/06* (2006.01)

(52) U.S. Cl.
CPC ..... *F23D 14/50* (2013.01); *F23G 7/06* (2013.01)

(58) Field of Classification Search
CPC ..... F23D 14/50; F23D 11/386; F23D 2900/00002; F23D 2900/21018; F23G 7/06

(Continued)

(56) References Cited

U.S. PATENT DOCUMENTS 1,958,400 A * 5/1934 Tullis ..... F23D 11/44 239/117
2003/0073050 A1* 4/2003 Zabriskie ..... F23D 14/50 431/123

(Continued)

FOREIGN PATENT DOCUMENTS

| | | | |
|---|---|---|---|
| EP | 2463579 | A | 6/2012 |
| JP | 2018040511 | A | 3/2018 |
| WO | 2018047678 | A1 | 3/2018 |

OTHER PUBLICATIONS

British Examination Report dated Apr. 2, 2020 and Search Report dated Apr. 1, 20 for corresponding British Application No. GB1914595. 2, 6 pages.

(Continued)

*Primary Examiner* — Ko-Wei Lin
(74) *Attorney, Agent, or Firm* — Theodore M. Magee; Westman, Champlin & Koehler, P.A.

(57) ABSTRACT

A method of cleaning a gas inlet nozzle of an abatement burner combustion chamber. The abatement burner intermittently receives gas for combustion from a feed process. The nozzle comprises a cleaning mechanism including a movable cleaning member for physically removing unwanted deposits from the nozzle. The cleaning member is movable from a retracted first position wherein the cleaning member is outside a path of a flame associated with the nozzle, to a second cleaning position wherein the cleaning member is in a path of the flame associated with the nozzle. The method comprises the steps of:

a. identifying when the nozzle is out of use;
b. moving the cleaning member from the first position to the second position while the nozzle is out of use; and
c. returning the cleaning member to the first position before nozzle is in use.

9 Claims, 2 Drawing Sheets

(58) Field of Classification Search
USPC ..... 431/3, 32, 121, 123
See application file for complete search history.

(56) References Cited

U.S. PATENT DOCUMENTS

| | | | | |
|---|---|---|---|---|
| 2015/0176838 | A1* | 6/2015 | Seeley | F23G 7/06 431/123 |
| 2017/0321892 | A1* | 11/2017 | Hutcheson | B08B 1/165 |
| 2018/0209644 | A1 | 7/2018 | Radiar | |

OTHER PUBLICATIONS

PCT Notification of Transmittal of the International Search Report and the Written Opinion of the International Searching Authority, or the Declaration dated Dec. 8, 2020 and PCT International Search Report dated Dec. 8, 2020 for corresponding PCT application Serial No. PCT/GB2020/052471, 6 pages.
PCT Written Opinion of the International Searching Authority, or the Declaration dated Dec. 8, 20 for corresponding PCT application Serial No. PCT/GB2020/052471, 7 pages.

* cited by examiner

GAS NOZZLE CLEANING METHOD AND SYSTEM

CROSS-REFERENCE TO RELATED APPLICATION

This application is a Section 371 National Stage Application of International Application No. PCT/GB2020/052471, filed Oct. 7, 2020, and published as WO 2021/069884 A1 on Apr. 15, 2021, the content of which is hereby incorporated by reference in its entirety and which claims priority of British Application No. 1914595.2, filed Oct. 9, 2019.

FIELD

The present invention relates to cleaning systems for a gas abatement system, gas abatement burners, and methods for cleaning gas inlet nozzles of abatement burners.

BACKGROUND

Abatement burners are used to treat exhaust gases from the manufacturing processes of, for example, semiconductors. Such treatment is important because the exhaust gases may be toxic and/or damaging to the atmosphere because of their high greenhouse activity.

One such exhaust gas treatment method involves combustion to remove harmful compounds from the gas stream. Typically, the exhaust gas is mixed with a fuel gas which is conveyed into a combustion chamber, via an inlet assembly, to be combusted. The inlet assembly typically comprises a nozzle structure, through which the gas mixture is conveyed. The gas mixture is combusted as it leaves the nozzle structure.

The inlet assembly typically further comprises a cleaning mechanism for removing solid deposits of the process gases that are formed on the nozzle structure as a result of the exhaust gas combustion. This cleaning mechanism may be, for example, a retractable cleaning spring designed to physically remove the deposits from the nozzle structure. However, it has been found that despite the presence of such a cleaning mechanism, deposits may still form on both the nozzle structure and the cleaning mechanism itself. The effects of these deposits are that they reduce the lifespan and/or functionality of the nozzle structure and cleaning mechanism, reduce the efficiency of the gas abatement system, and increase machine downtime when repairing and replacing such components.

In cleaning methods of the prior art, the operation of a cleaning member has resulted in the cleaning member being placed into the path of the flames. It has been found that deposits, for example aluminium oxide, may form on the distal end of the nozzle, even when a cleaning member has been used. This may lead to restriction of the nozzle, and/or burn-back within the nozzle, and/or reduced nozzle conductance, and/or distortion of the flame which can, in turn, cause incomplete combustion and the production of unwanted hydrocarbons and carbon monoxide.

Additionally, such deposits have also been found to form on the cleaning member itself, particularly at the distal end which is in the flame. Furthermore, the cleaning member itself has been found to be damaged during the use of the cleaning mechanism. The cleaning member has become cracked, sometimes to the extent where portions of the cleaning member have broken off completely, which prevents it from achieving its intended purpose.

Without wishing to be bound by theory, the inventors have found that such deposition and cracking as detailed above may be encouraged by the cleaning member passing through the flame associated with the nozzle during the nozzle cleaning process. By being repeatedly inserted and retracted from the flame, the cleaning member undergoes repeated heating and cooling cycles. The cracking of the cleaning member may be as a result of the introduction and propagation of micro-cracks due to multiple cycles of heating followed by rapid cooling. Therefore, it is desirable to provide an improved nozzle cleaning system and method that avoids these issues.

The discussion above is merely provided for general background information and is not intended to be used as an aid in determining the scope of the claimed subject matter. The claimed subject matter is not limited to implementations that solve any or all disadvantages noted in the background.

SUMMARY

Accordingly, in a first aspect, there is provided a method for cleaning a gas inlet nozzle of an abatement burner combustion chamber. The abatement burner may intermittently receive gas for combustion from a feed process. The nozzle may comprise a cleaning mechanism including a movable cleaning member for physically removing unwanted deposits from the nozzle. The cleaning member being movable from a retracted first position wherein the cleaning member is outside a path of a nozzle flame associated with the nozzle to a second position (a cleaning position) wherein the cleaning member is in the path of the nozzle flame. The method comprises the steps of identifying when the nozzle flame is off; moving the cleaning member from the first position to the second position while the nozzle flame is off; and returning the cleaning member to the first position before nozzle flame is on (e.g. ignited). Movement of the cleaning member from a retracted first position to the second cleaning position may physically remove unwanted deposits from the nozzle if said unwanted deposits are present.

For the purpose of the invention, the path of the nozzle flame refers to a volume defined by the maximum volume occupied by the nozzle flame during use of the nozzle, i.e. during combustion. It will be understood that the path of the nozzle flame, may or may not actually contain the flame depending on whether the nozzle flame is on or off. Typically, the cleaning member does not pass the end of the nozzle while the nozzle flame is on. Additionally, or alternatively, the cleaning member does not enter the path of the nozzle flame when the nozzle exit temperature is greater than about 1000° C. Preferably, the cleaning member may only be in the first position when the nozzle exit temperature is less than about 1000° C., preferably less than 600° C., preferably at an ambient (e.g. room) temperature.

The abatement burner may comprise a radiant burner. Typically, a radiant burner may comprise an inward-firing radiant combustor, preferably a substantially tubular combustor. Typically, in use, gasses from the feed process flow from the nozzle into the combustor wherein they undergo heating and additional chemical processes such as combustion, oxidation, or reduction. Preferably, these reactions may occur in a region of substantially laminar flow away from the walls of the combustor to prevent deposition of oxides thereon.

The abatement burner may have a plurality of modes of operation, each mode providing specific nozzle conditions and, in particular, specific nozzle exit temperatures. Typically, an abatement burner may have four modes of operation.

In a first mode the abatement burner is off. Typically, when the abatement burner is off there is no process gas flow (i.e. gas for combustion from a feed process), any pilot burner is off, any radiant burner is off, and the nozzle flame is off. Typically, the temperature at the nozzle exit is at a substantially ambient temperature, e.g. substantially room temperature (about 20° C.).

In a second mode the abatement burner is in an idle mode. Typically, the idle mode is characterised by there being no process gas flow, any pilot burner being on, any radiant burner being off, and the nozzle flame being off. In an idle mode, the nozzle exit temperature is typically at a substantially ambient temperature, e.g. substantially room temperature (about 20° C.).

In a third mode the abatement burner is in a radiant burner mode. Typically, the radiant burner mode is characterised by process gas flow entering the combustion chamber via the nozzle, any pilot burner being on, the radiant burner being on, and the nozzle flame being off. In the radiant burner mode, the nozzle exit temperature is typically from about 600° C. to about 1000° C.

In a fourth mode the abatement burner may be a flame mode. The flame mode may be characterised the process gas flow entering the combustion chamber via the nozzle, any pilot burner being on, any radiant burner being on, and the nozzle flame being on. In the flame mode, typically the nozzle exit temperature is from about 1000° C. to about 1800° C. Typically, a fuel such as methane (e.g. natural gas), propane or butane (e.g. liquified petroleum gas) or hydrogen is added to the process gas and supported by an oxidant (e.g. oxygen or CDA) is ignited to form the nozzle flame. The fuel may comprise methane, e.g. natural gas.

Typically, the cleaning member may be moved from a first position to a second position when the abatement burner is off or in idle mode. Furthermore, the cleaning member may be moved back to a first position before the abatement burner is in a flame mode. Additionally, or alternatively, the cleaning member may be in a first position or second position when the abatement burner is in a radiant burner mode.

During use of the abatement burner, the one or more nozzle flames and/or radiant burner may be switched on and off at intervals. It has been found that by associating the movement of the cleaning mechanism to the operation of the nozzle flame, such that the cleaning member does not enter the path of the nozzle flame when the nozzle flame is on, the amount of deposition and cracking on the nozzle and/or cleaning member can be reduced significantly. Preferably, the cleaning member may not enter the path of the nozzle flame when the nozzle flame is on.

Advantageously, this may reduce the amount of maintenance required for the cleaning member and/or nozzle and minimises machine down-time. Furthermore, it prolongs the lifespan of the components.

By preventing the cleaning member from entering the path of the nozzle flame when the nozzle flame is on, the nozzle cleaning mechanism will operate more efficiently, allowing for an increased mean time between failures.

Typically, the first position may comprise substantially all of the cleaning member being out of the path of the nozzle flame.

In a further aspect, the present invention provides a method of cleaning a gas inlet nozzle of an abatement burner combustion chamber. The abatement burner may intermittently receive gas for combustion from a feed process. The nozzle may comprise a cleaning mechanism including a movable cleaning member for physically removing unwanted deposits from the nozzle. Typically, the cleaning member being movable from a retracted first position wherein the cleaning member is outside a path of a nozzle flame associated with the nozzle to a second cleaning position wherein the cleaning member is in the path of the nozzle flame associated with the nozzle.

The method comprises the steps of identifying a step in the feed process when gas from the feed process is provided to the abatement system for combustion; and directing the movement of the cleaning member to ensure the cleaning member is in the first position during the identified step, preferably for the duration of the identified step. By preventing the operation of the cleaning mechanism during the identified step in the feed process, the cleaning member remains away from the nozzle flame at that time. By synchronising the operation of the cleaning mechanism to a particular step in the feed process when gas is provided to the abatement system for combustion, the build-up of deposits on both the cleaning mechanism and the nozzle, as well as the cracking and wear of the cleaning member can be reduced. Advantageously, this may increase the mean time between failures, and increase the overall efficiency of the gas abatement process.

During the method as described, there may still be material deposited on the nozzle when the cleaning member is retracted in a first position, but this will be cleared off by the correct operation of the cleaning mechanism. Thus, the present invention ensures that cleaning mechanism itself is more effective.

Additionally, the content of the gas from a feed process may vary and the method may further comprise the steps of identifying a step in the feed process when a specific gas chemistry is being provided to the abatement system for combustion; and directing the movement of the cleaning member to ensure the cleaning member is in the first position for the duration of the identified step.

There may be specific gas chemistries that are particularly detrimental to the operation of the cleaning mechanism due to, for example, increased combustion temperatures and/or increased deposition rates and/or more corrosive chemistry. Advantageously, step (b) as described above ensures that the cleaning mechanism is prevented from damage by said specific gas chemistries. Specifically, harmful gas chemistries may include, for example, volatile aluminium chloride mixed with organic residues, which may arise from aluminium etch recipes. This material may coat the cleaning spring such that if the cleaning spring is moved into a flame the aluminium compound may rapidly react to form aluminium oxide. The aluminium oxide may coat the cleaning spring to form layers of deposits that are substantially immovable. Over time, such deposits may build up to form a solid plug that can block the nozzle.

Additionally, the method may further comprise identifying all such steps in the feed process and directing the movement of the cleaning member to ensure the cleaning member is in the first position for the duration of all the identified steps.

Typically, the method may further comprise the step of moving the cleaning member to the second position when the nozzle flame is out of use. In this instance "out of use" refers to when no combustion is occurring. Preferably, the method may further comprise the step of cycling the cleaning member to the second position when the nozzle flame is off or the radiant burner and nozzle flame are off.

Preferably, the second position comprises the distal end of the cleaning member reaching the distal end of the nozzle. Advantageously, by ensuring that the cleaning member is moved to a second position when the nozzle flame is out of use, any build-up of deposits formed on the nozzle when the cleaning member is in a first position may be removed. The more regular the removal of the deposits from the nozzle, the less likely it is that the overall performance of the abatement burner will be affected.

Typically, the method may further comprise the step of returning the cleaning member to first position before the occurrence of one of the identified steps and/or the nozzle flame is returned to use. Thus, it is ensured that the cleaning member remains in the first position whenever it might be susceptible to increased deposit and/or damage as described previously. Beneficially, this increases the effectiveness and the mean time between failures.

In a further aspect, a cleaning system for a gas inlet nozzle of an abatement system combustion chamber is provided. The abatement system may intermittently receive exhaust gas for combustion from a feed process. The cleaning system may comprise a cleaning mechanism associated with the nozzle including a movable cleaning member for removing unwanted deposits from the nozzle. The cleaning member being movable from a first position wherein the cleaning member is outside a path of the flame associated with the nozzle to a second position wherein the cleaning member is in the path of the flame associated with the nozzle. The system may be configured to coordinate movement of the cleaning member such that the cleaning member is in the first position before and during the provision of exhaust gas by the feed process to the nozzle for combustion.

As described previously, it has been found that by associating the movement of the cleaning mechanism to the provision of exhaust gases, and hence to the presence of the flame, such that the cleaning member does not enter the path of the flame during combustion, that the amount of deposition and cracking of the cleaning member can be reduced significantly. Advantageously, this reduces the amount of maintenance required for the cleaning mechanism and nozzle and minimises machine down-time. Furthermore, it prolongs the lifespan of the components.

By preventing the cleaning member from entering the path of the flame during the time that the flame is present, the nozzle cleaning mechanism will operate more efficiently, allowing for an improved mean time between failures. Preferably, the cleaning member may further be prevented from entering the path of the flame during the time that the radiant burner is on.

There may still be deposit build-up on the inside of the nozzle during use, but this may be removed by the correct use of the cleaning mechanism.

Typically, the coordinated movement of the cleaning member of the cleaning system may be automated. Advantageously, this improves the efficiency of the cleaning system and thus the efficiency of the abatement system.

In a further aspect, a gas abatement burner comprising a combustion chamber may be provided, wherein said combustion chamber may comprise a gas inlet nozzle and a cleaning system as described herein.

Preferably, the gas abatement burner may be an Atlas Etch system or Atlas ULF system.

Typically, the gas abatement burner may comprise a plurality of gas inlet nozzles each having an individual cleaning system associated therewith. Preferably, the gas abatement burner may comprise at least 1 gas inlet nozzles, more preferably at least 4 gas inlet nozzles, more preferably up to about 10 gas inlet nozzles, for example 6 gas inlet nozzles.

Advantageously, having an individual cleaning system associated with each of the plurality of gas inlet nozzles ensures that each gas inlet nozzle remains clear of deposit build-up, thus the overall efficiency of the gas abatement burner is improved.

Typically, each cleaning system may be independently coordinated with an external process with which it is associated. Such external processes may include, for example etching or chemical vapour deposition processes as used in the semiconductor industry. This is advantageous in comparison to operating all the cleaning systems simultaneously and/or on a timer, as it ensures that each cleaning system is only operated at the optimal time in relation to the external process with which it is associated. This ensures the prevention of excessive build-up of deposit during use on each gas inlet nozzle. Beneficially, this allows for improved efficiency of the gas abatement burner, whilst also increasing the mean time between failures. Furthermore, it allows each inlet nozzle and cleaning system to operate independently and be kept running efficiently.

In a further aspect a method or system as described herein wherein the cleaning member may a helical cleaning spring is provided. Preferably, the helical spring may be coupled to an actuator, which provides for reciprocal displacement of the helical spring in the axial direction of the nozzle between first and second positions, to clean any deposits forming on the nozzle structure.

For the avoidance of doubt, all aspects described hereinbefore may be combined mutatis mutandis.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

Figure 1:
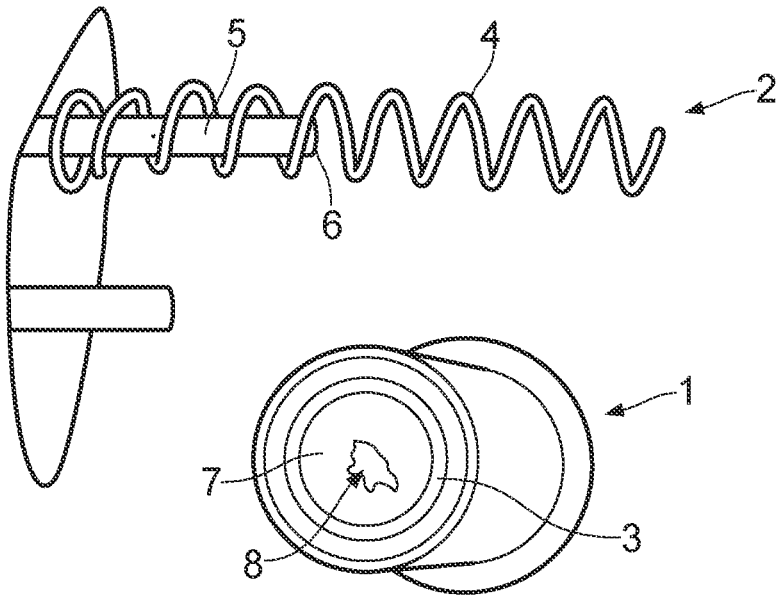
FIG. 1 (Prior Art)
FIG. 1 shows a nozzle with a short cleaning spring, along with the accompanying nozzle.

As illustrated in FIG. 1, a nozzle structure (1) and cleaning member (2) according to the prior art are shown. The nozzle structure (1) has a nozzle (3). The nozzle (3) has a central conduit which is configured to be placed over the cleaning member (2) such that the nozzle (3) acts as a sleeve surrounding the cleaning member (2).

The cleaning member (2) comprises a substantially helical spring (4). The substantially helical spring (4) may also be known as a "cleaning spring". A lance (5) is positioned coaxially with the cleaning spring (4) such that the cleaning spring (4) surrounds the lance (5). In use, gases travel through the lance (5) and are expelled from a distal end of the lance (6) for combustion.

At a first end, the cleaning spring (4) is coupled to an actuator (not shown), which provides reciprocal displacement of the cleaning spring (4) in the axial direction of the nozzle (3) between first and second positions. In FIG. 1, the cleaning spring (4) is shown in the second position, wherein it extends beyond the distal end of the lance (6). In the first position (not shown), the cleaning spring (4) is retracted by the actuator such that it does not extend beyond the distal end of the lance (6).

As can be seen, the distal end of the nozzle (3) has a build-up of deposit (7) in the central conduit. The deposit (7) build-up has caused the aperture (8) through which gas may leave the nozzle (3) to become reduced in size and to have an irregular shape. This may result in reduced efficiency of the gas abatement system. If the nozzle (3) becomes blocked by deposit (7) then burn-back within the nozzle (3) may occur, which may result in distortion or damage of the nozzle. The deposit (7) build-up on the nozzle may also reduce the conductance of the nozzle (3). Deposit (7) build-up may additionally result in distortion of the nozzle flame (not shown) which can lead to incomplete combustion of the process gases and the production of unwanted hydrocarbons and/or carbon monoxide.

The cleaning spring (4) shown is a "short" cleaning spring. This means that it is less than about 50 mm in length. As shown, there is no build up of deposit (7) on the "short" cleaning spring (4), but it is no longer capable of cleaning the entire nozzle (3) and accordingly has resulted in a build-up of deposit (7) in the central conduit that could not be cleared. This may result in the reduction of the efficiency of the nozzle, and potentially the eventual blockage and failure. To enable the cleaning spring (4) to clean the entire nozzle (3), when the cleaning spring (4) is in the second position, the helical cleaning spring (4) should typically have sufficient length such that it extends beyond the end of the nozzle (3) distal to the actuator. Preferably, the helical cleaning spring (4) is of sufficient length such that at least one helix, more preferably at least two helixes of the cleaning spring (4) extend beyond the end of the nozzle (3) distal to the actuator when the cleaning spring (4) is in the second position. If other cleaning members are employed they too may extend beyond the end of the nozzle when in the second, cleaning position.

Figure 2:
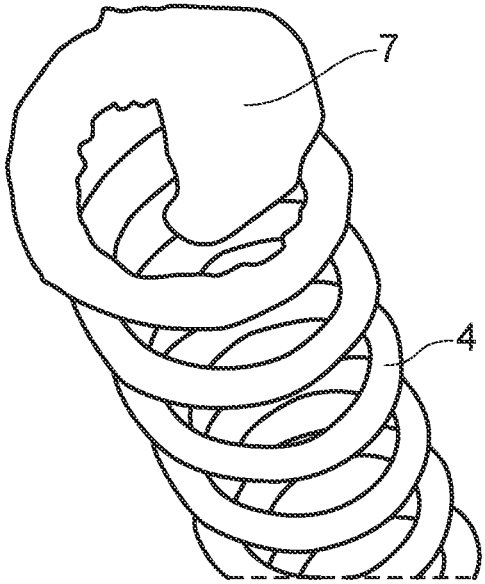
FIG. 2 (Prior Art)
FIG. 2 shows nozzle deposition as seen in a cleaning mechanism of the prior art.

FIG. 2 illustrates a cleaning spring (4) according to the prior art. As can be seen, at the end of the cleaning spring (4), there has been a build-up of deposit (7). This deposit (7) has formed as a result of the cleaning spring (4) being placed in the path of the flame (not shown) during operation of the gas abatement system. The build up of deposit (7) on the cleaning spring (4) will reduce the efficiency of the gas abatement system as the deposit (7) will be in the path of the flame. Additionally, it may cause damage to the cleaning spring (4) and reduce the life span of the component.

Figure 3:
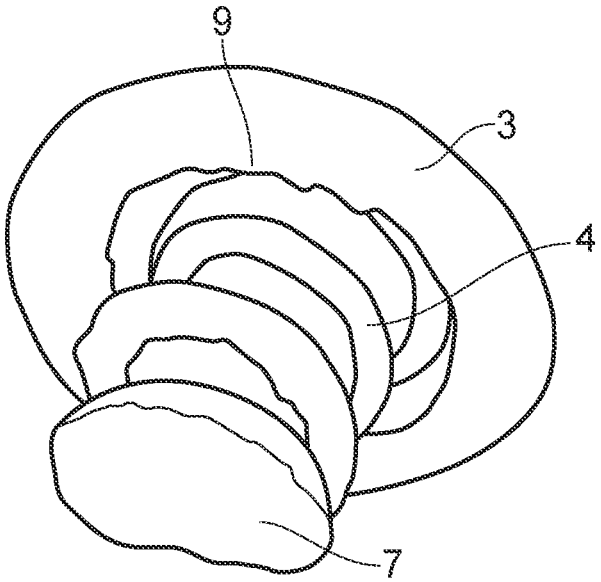
FIG. 3 (Prior Art)
FIG. 3 shows nozzle deposition as seen in further cleaning mechanism of the prior art.

As illustrated in FIG. 3, a cleaning spring (4) according to the prior art can be seen, wherein the cleaning spring (4) again exhibits a build-up of deposit (7). In this instance, the deposit has covered the entirety of the distal end of the cleaning spring (4). This will block the direct path of the flame as it leaves the lance (not shown), which may reduce the efficiency of the gas abatement system, and may also lead to further heating of the cleaning spring (4). The heating of the cleaning spring (4) may lead to further build-up of deposit (7) and even possibly to cracking and failure of the cleaning spring (4).

It can also be seen that there has been deposit (9) that has built-up on the edge of the nozzle (3). This may be a further impact of the blockage of the end of the cleaning spring (4) by deposit (7).

Figure 4:
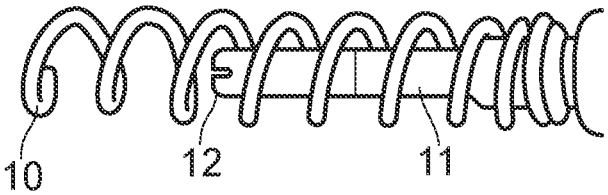
FIG. 4 shows a cleaning mechanism of the present invention.

FIG. 4 illustrates a cleaning spring (10) according to the present invention. As described herein previously, the cleaning spring (10) has a substantially helical shape and surrounds the lance (11). The cleaning spring (10) is configured to fit within and be substantially surrounded by a nozzle (not shown).

During operation of the gas abatement system, gases pass through the lance (11) and are expelled from a distal end of the lance (12) for combustion. As described previously, the position of the cleaning spring (4) is movable between a first position, wherein the cleaning spring (10) is outside the path of the flame associated with the nozzle, and a second position, wherein the cleaning spring (10) is in the path of the flame associated with the nozzle. The position of the cleaning spring (10) may be configured to be associated with a step in a feed process when gas is provided to the abatement for combustion, and/or with a step in the feed process when a specific gas chemistry is being provided.

As shown, by associating the movement of the cleaning spring (10) with a process step or gas chemistry, the build-up of deposits on the cleaning spring (10) and/or the nozzle can be prevented. Also, by ensuring that the cleaning spring (10) is not in the path of the flame associated with the nozzle during combustion, damage to the cleaning spring (10) can be minimised. Overall this results in an increased mean time between failures.

It will be appreciated that various modifications may be made to the embodiments shown without departing from the spirit and scope of the invention as defined by the accompanying claims as interpreted under patent law.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A method of cleaning a gas inlet nozzle of an abatement burner of a combustion chamber, the abatement burner comprising a radiant burner, the abatement burner intermittently receiving gas for combustion from a feed process, the nozzle comprising a cleaning mechanism including a movable cleaning member for removing unwanted deposits from the nozzle, the cleaning member being movable from a retracted first position wherein the cleaning member is outside a path of a flame associated with the nozzle to a second cleaning position wherein the cleaning member is in the path of the flame associated with the nozzle; the method comprising the steps of:

a. identifying when the nozzle flame is off while the radiant burner is on;

b. moving the cleaning member from the first position to the second position while the nozzle flame is off and the radiant burner is on; and c. returning the cleaning member to the first position before the nozzle flame is on.

2. A method of cleaning a gas inlet nozzle of an abatement burner of a combustion chamber, the abatement burner intermittently receiving gas for combustion from a feed process, the nozzle comprising a cleaning mechanism including a movable cleaning member for removing unwanted deposits from the nozzle, the cleaning member being movable from a retracted first position wherein the cleaning member is outside a path of a flame associated with the nozzle to a second cleaning position wherein the cleaning member is in the path of the flame associated with the nozzle; the method comprising the steps of:

a. identifying a step in the feed process when gas is provided to the abatement burner, a flame is provided at the nozzle, and a radiant burner of the abatement burner is on;

b. directing the movement of the cleaning member to ensure the cleaning member is in the first position during the identified step;

c. identifying a second step in the feed process when gas is provided to the abatement burner, there is no flame provided at the nozzle, and the radiant burner is on; and d. moving the cleaning member to the second cleaning position during the second step.

3. The method according to claim 2 wherein the method comprises the steps of:

a. identifying a third step in a feed process when the gas having a specific gas chemistry is being provided to the abatement burner; and b. directing the movement of the cleaning member to ensure the cleaning member is in the first position for the duration of the third step.

4. The method according to claim 2 comprising the step of returning the cleaning member to first position before the nozzle flame is returned to use.

5. A cleaning system for a gas inlet nozzle of an abatement system combustion chamber, the abatement system comprising a radiant burner, the abatement system intermittently receiving exhaust gas for combustion from a feed process, the cleaning system comprising:

a cleaning mechanism associated with the nozzle including a movable cleaning member for removing unwanted deposits from the nozzle, the cleaning member being movable from a first position wherein the cleaning member is outside a path of the flame associated with the nozzle to a second position wherein the cleaning member is in the path of the flame associated with the nozzle;

wherein the system is configured to coordinate movement of the cleaning member such that:

the cleaning member is in the first position when the flame is not present at the nozzle while the radiant burner is on; and the cleaning member is in the second position when the flame is not present at the nozzle and the radiant burner is on.

6. The cleaning system according to claim 5 wherein the coordinated movement of the cleaning member is automated.

7. A gas abatement burner comprising a combustion chamber, said combustion chamber comprising a cleaning system according to claim 5.

8. The gas abatement burner according to claim 7 comprising a plurality of gas inlet nozzles each having an individual cleaning system associated therewith.

9. The gas abatement burner according to claim 8 wherein each cleaning system is independently coordinated with an external process with which it is associated.

* * * * *